United States Patent [19]

Saad

[11] 4,420,370

[45] Dec. 13, 1983

[54] PULP AGITATING DEVICE AND METHOD HAVING MULTIPLE PROTRUDING INSERTS

[75] Inventor: Nabil R. Saad, Kanata, Canada

[73] Assignee: JWI Ltd., Ontario, Canada

[21] Appl. No.: 399,344

[22] Filed: Jul. 19, 1982

[51] Int. Cl.[3] ..... D21F 1/54

[52] U.S. Cl. ..... 162/209; 162/352; 162/374

[58] Field of Search ..... 162/352, 356, 374, 300, 162/208, 209, 308, 312

[56] References Cited

U.S. PATENT DOCUMENTS

| | | | |
|---|---|---|---|
| 3,573,159 | 3/1971 | Sepall | 162/208 |
| 3,574,054 | 4/1979 | Taylor, Jr. | 162/352 |
| 3,836,428 | 9/1974 | McConaughy | 162/374 |
| 3,874,998 | 4/1975 | Johnson | 162/374 |
| 3,992,254 | 11/1976 | Lehtinen | 162/300 |
| 4,134,788 | 1/1979 | Witworth | 162/374 |
| 4,140,573 | 2/1979 | Johnson | 162/374 |

*Primary Examiner*—Steve Alvo

*Attorney, Agent, or Firm*—Oblon, Fisher, Spivak, McClelland & Maier

[57] ABSTRACT

Relatively small easily exchangeable wear resistant inserts are mounted in a plurality of lengthwise grooves in a forming board or foil blade of a paper making machine so that a portion of each insert protrudes above the surface of the blade to form cross-machine direction channels on the blade. The channels promote agitation of the pulp stock on the forming fabric as it passes in contact with the blade.

15 Claims, 7 Drawing Figures

PULP AGITATING DEVICE AND METHOD HAVING MULTIPLE PROTRUDING INSERTS

BACKGROUND OF THE INVENTION (a) Field of the Invention

This invention relates to an apparatus and method for agitating the pulp suspension on the forming fabric of a paper making machine and particularly for disturbing the initial fiber mat in the region of the forming board and/or for deflocculating the pulp suspension in the region of dewatering foils.

(b) Description of the Prior Art

In the paper forming section of a paper making machine pulp stock, which is a thin suspension of fibers and fillers containing generally about 99.5% water, is flowed or ejected from a headbox slice at the upstream end of the section onto the surface of a moving endless screen belt, called a forming fabric, which is made of woven metal or plastic filaments. The forming fabric passes over various fabric support devices which withdraw some of the water from the pulp stock leaving on the fabric a thin, self-supporting formation of matted fibers. This mat is lifted off the fabric at the downstream end of the section and is passed through a press section where more water is removed by mechanical means and then through a dryer section where dewatering is completed by evaporation.

In the conventional Fourdrinier type machine the pulp stock is discharged from the slice onto a nearly horizontally disposed forming fabric and is dewatered as the fabric runs over a forming board, table rolls and/or foils and suction boxes. In recent years twin wire machines have been gaining popularity because of greater speed capability and requiring less space and energy. There are several known types, each involving the ejection of pulp stock onto a forming fabric as it converges with another fabric running in the same direction and at the same speed. The fabrics are arranged to converge until they run together in a dewatering zone with the layer of pulp sandwiched between them. In some of these machines the dewatering zone includes a forming board, foils and an arcuate or curved shoe which may be adapted to embody the present invention.

Regardless of which type of paper machine is used the quality of the finished paper depends to a large extent on the uniformity of the suspension of fibers in the pulp stock being maintained while water is being withdrawn and until the fibers are no longer in suspension but have formed a fibrous mat. A well distributed and uniform pulp discharge from the slice is readily obtainable by thorough mixing in the headbox and by micro-scale turbulence produced within the discharge nozzle of the slice. However, this turbulence decays rapidly and dissipates before it can be effectively used at or just beyond the point of impingement of the pulp discharge on the forming fabric. Thus, unless specific means are employed to produce continual disturbance in the stock suspension, the fibres of the pulp will immediately commence to agglomerate and form flocs which reduce retention and drainage throughout the formation zone and this results in poor fiber formation in the finished sheet of paper.

Continual disturbance of fibers in the stock in the initial stages is also beneficial in overcoming what is known as "pressure formation" where too much initial drainage occurs as a result of the combined effect of the vacuum created by breast roll discharge action and the impact of the pulp jet impinging on the fabric at relatively steep angles. This causes premature embedment of a mat of fibers into the forming fabric and significantly decreases subsequent drainage and deflocculation.

Many methods have been proposed to agitate the fibers of the stock after it has been deposited on the fabric. A well known method, which is applicable to fairly small, slow running paper machines, is to mechanically shake the whole upstream frame of the machine. In cases where it is not practical to shake a massive framework, smaller components of the machine such as table rolls, or foils have been caused to shake or vibrate. Other methods involve the development of a succession of pressure pulses in the pulp suspension and these include rotating a roll having a textured surface close to the underside of the forming fabric as in U.S. Pat. No. 4,306,934 (Seppanen), interrupted foiling action as in U.S. Pat. No. 3,573,159 (Sepall) and U.S. Pat. No. 3,874,998 (Johnson), and intermittent foiling action at the forming board as in U.S. Pat. No. 3,598,694 (Wiebe). Still other methods involve the creation of intermittent lateral flow in the stock suspension by induced uneven drainage as in U.S. Pat. No. 1,917,098 (Cofrin) or by upwardly directed air jets at the forming board as in the U.S. Pat. No. 3,149,026 (Hornbostel). Still other methods include rapid vertical oscillation of the forming fabric as it travels through the forming zone over corrugated suction box covers as in U.S. Pat. No. 3,102,066 (Justus) or over specially designed or positioned foil blades that promote vertical undulations as in U.S. Pat. No. 3,922,190 (Cowan) and U.S. Pat. No. 4,140,573 (Johnson).

A disadvantage inherent in the above mentioned prior art is that agitation is not produced close enough to the point where formation commences as the pulp stock impinges on the forming fabric so that initial sealing of the fabric by fibers of stock is prevented. Another disadvantage of the prior art is that agitation is produced only on a macro-scale and the turbulence it produces is not fine scale enough to augment and maintain the micro-scale turbulence in the pulp stream issuing from the slice. Another disadvantage of the prior art is that the various devices are of fixed configuration and are not easily changed to meet operational changes required by variations of pulp stock. Still another disadvantage of the prior art is that components of the machine which initiate agitation are subject to wear and, over a period of time, the turbulence created by them is not constant.

SUMMARY OF THE INVENTION

A feature of the present invention is to overcome the disadvantages of the prior art and to provide certain positive advantages which will be apparent from the following description.

Broadly, the present invention provides a support member such as a forming board blade, foil blade or curved shoe having a series of channels in a support surface thereof and extending in the cross-machine direction to induce pressure pulses in the pulp suspension on the forming fabric which passes over them.

The agitating channels of the present invention are somewhat similar in shape to those of Sepall and Johnson in that they have sloping side walls and a closed bottom so that water drained into them is forced upward against and through the fabric to agitate the stock.

However, the channels of the invention are distinguished from those of these references by the fact that they are formed of a series of easily replaceable, low friction, wear resistant inserts that protrude above the surface of the forming board or foil element. Preferably, the forming board, foil or shoe element will be made of easily machineable material such as high density, high molecular weight polyethylene and a plurality of wear resistant protruding inserts will be evenly dovetailed into the surface of the element so that the portions of these that protrude will form the opposing sloping side walls of channels and a fabric contacting surface between channels. The bottoms of channels, which incidently are not subjected to wear by the fabric, are formed by the surface of the forming board or foil element.

There are many advantages provided by this method of construction which are not found in the prior art and which include, for example, the following:

1. The protruding inserts may be made of any type of wear resistant material such as, for example, tungsten carbide or aluminum oxide.

2. The inserts may be made very small and may be placed closely together in the forming board, foil or shoe element in order to provide agitating pressure pulses on a micro-scale.

3. The inserts provide reduced contact area of the fabric on the forming board, foil or shoe element which reduces friction.

4. While the lower portion of the inserts may be shaped to a standardized dovetail, the upper, protruding portion may be shaped in various ways to provide channels of various configurations.

5. The element to which the protruding inserts are attached may be made of any easily machineable material so that dovetailed retaining grooves are easy to make and are standardized to provide secure and accurate positioning of the inserts.

6. The inserts are easily detachable and may be replaced by simply sliding them out of their retaining grooves if it is desirable to provide a different channel configuration.

7. The elements to which the protruding inserts are attached may be equipped with the T-Bar method of attachment, as disclosed in U.S. Pat. No. 3,337,394, so that they may be removed from the paper machine easily in the event a change of channel configuration is required.

8. The channels formed by the protruding inserts are not affected by normal wear and retain their shape to provide consistent agitation over an extended period of time.

According to a broad aspect of the present invention there is provided a pulp agitating device comprising a support member having a single upper surface. A plurality of slots are formed in the upper surface. Each of the slots has retention means for holding a respective one of a plurality of inserts in sliding engagement therein. The inserts are closely spaced and disposed in parallel relationship to one another and extend in a cross-machine direction and protrude above the upper surface to form cross-machine channels therebetween. The support member is supported in contact with a moving endless forming fabric of a paper-making machine to induce micro-pressure pulses to the moving forming fabric whereby to agitate fibers in pulp suspension on the fabric to obtain better distribution of the fibers.

According to a further broad aspect of the present invention, there is provided a method of agitating fibers in a pulp suspension in a moving endless forming fabric of a paper-making machine. The method comprises the steps of positioning a support element having a single upper surface having formed therein a plurality of slots provided with retention means for holding a respective one of a plurality of inserts in sliding engagement therein. Inserts are positioned in the slots in closely spaced parallel relationship to one another and extend in a cross-machine direction and protrude above the upper surface to form cross-machine channels therebetween. A surface of the forming fabric is displaced in contact with the inserts while supporting on an opposite surface the pulp suspension. Micro-pressure pulses are induced into the moving fabric by means of the channels whereby to agitate fibers in the pulp suspension to obtain better distribution of the fibers.

BRIEF DESCRIPTION OF DRAWINGS

Further features, objects and advantages of the present invention will be evident from the following detailed description of examples of the preferred embodiment when considered in conjunction with the accompanying drawings in which.

DESCRIPTION OF PREFERRED EMBODIMENTS

Figures 1, 2:
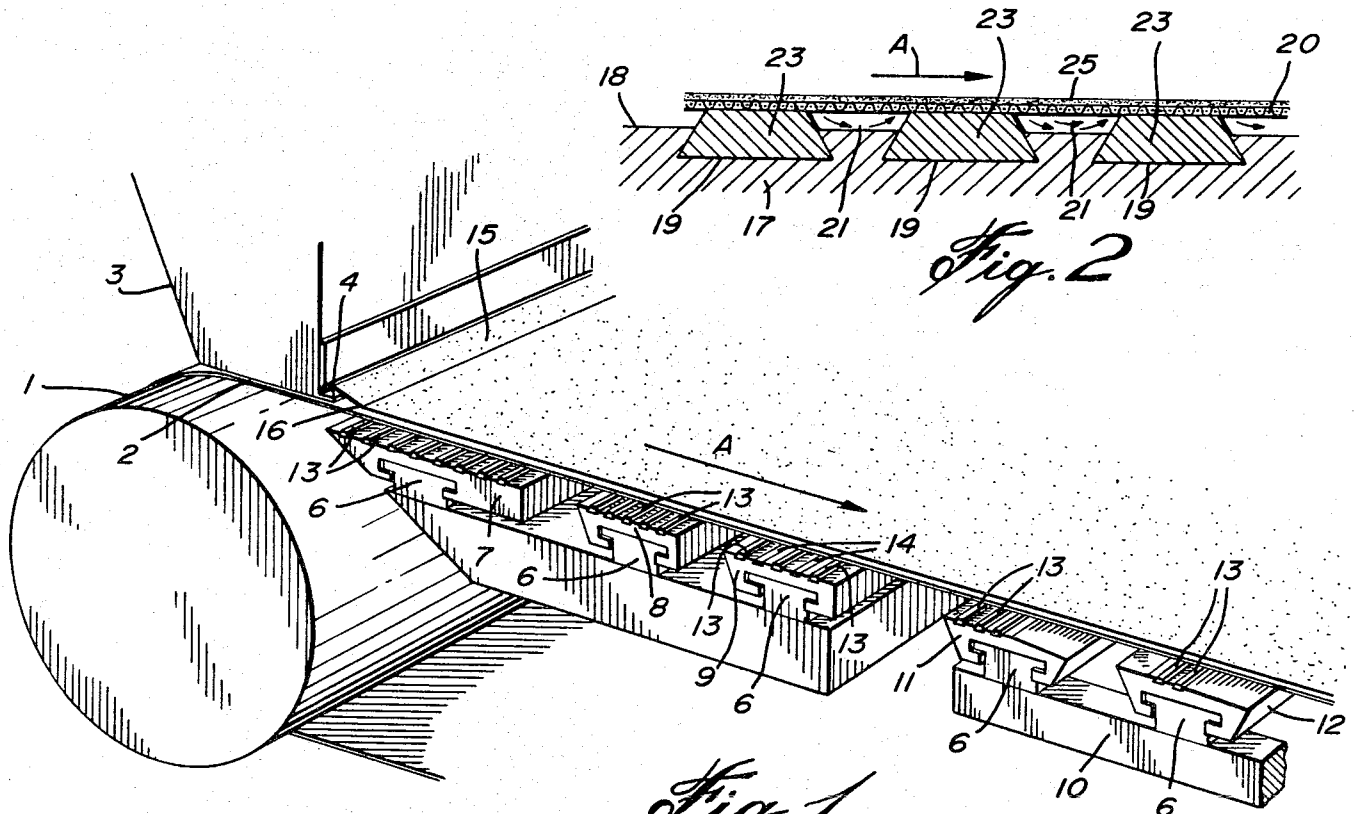
FIG. 1 is a perspective view of a typical wet-end section of a Fourdrinier paper making machine illustrating schematically several examples of the invention.
FIG. 2 is a schematic cross-sectional view, on an enlarged scale, of an example of the invention.

Referring to FIG. 1, a breast roll 1 is shown over which a Fourdrinier forming fabric 2 passes in the direction shown by the arrow A. A jet of wet pulp stock 15 is discharged from the slice 4 of head box 3 onto the fabric 2. A forming board frame 5 is shown supporting forming board blades 7, 8 and 9, which extend the width of the machine and are detachably mounted on T-shaped rails 6 fastened to frame 5 shown here as they might be placed in the primary dewatering stage of papermaking. Foil blades 11 and 12 also extend the width of the machine and are detachably mounted on T-shaped rails 6 which are fastened to a frame member shown in part at 10. The T-rails also extend the width of the machine. Frame members 5 and 10 are atached to the side rails of the paper machine which are not shown.

Figure 6:
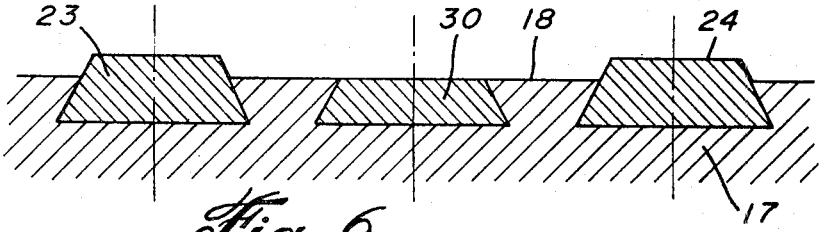

In the various examples shown in FIG. 1, the protruding inserts of the invention are shown at 13. For example, in the first blade 7, eight protruding inserts are shown. In the second blade 8, there are five and in the third blade 9, there are three protruding inserts and two flush mounted filler inserts 14, indicating another example by which spacing or pitch between protruding inserts may be doubled or trippled by flush-mounting the filler insert or inserts on the blade as shown in FIG. 6.

The jet of pulp stock is indicated at 15 and the point of impingement of the stock on the fabric, usually just upstream of the leading edge of the first forming board blade, is shown at 16.

While the main feature of the invention is to provide a plurality of protruding inserts in forming board blades, protruding inserts may also be provided in the fabric supporting land surface of a foil blade as shown at blade 11 or in the downward sloping foiling surface of a foil blade as shown at blade 12.

Referring now to FIG. 2, numeral 17 denotes a section of a forming board blade which may be made from a solid bar of easily machineable plastic such as high density high molecular weight polyethylene. Numeral 18 denotes the surface of the blade which faces the forming fabric. Dovetailed grooves 19, extending across the width of the machine, are cut in surface 18 and protruding inserts, made of wear resistant material such as aluminum oxide, tungsten carbide or stainless steel coated with tungsten carbide and fashioned in corresponding dovetailed shape, are slid lengthwise into the dovetailed grooves in the surface of the blade so that the upper portion of the insert projects or protrudes above the surface 18. The inserts may be single lengths of coated stainless steel or they may be conveniently made in a plurality of relatively short sections placed and held in end-to-end relationship in the dovetailed grooves. If desired, the short insert sections may be held tightly together with a holding device as illustrated in U.S. Pat. No. 3,732,142, in which case, the grooves in the blade would be provided with channels to accommodate the holding device. As shown in FIG. 2 the fabric 20 runs over inserts 23 in the direction of arrow A and supports the layer of pulp suspension 25. In operation, water drains downward through fabric 20 into the upstream side of channel 21, formed by pairs of protruding inserts 23. At the downstream side of these channels the water is forced upward through the fabric thus creating a small pressure pulse in the pulp stock 25. The action is similar to that described in U.S. Pat. No. 3,874,998 but on a micro-scale to match and augment the micro-scale turbulence in the pulp stream issuing from the headbox slice.

Figure 3:
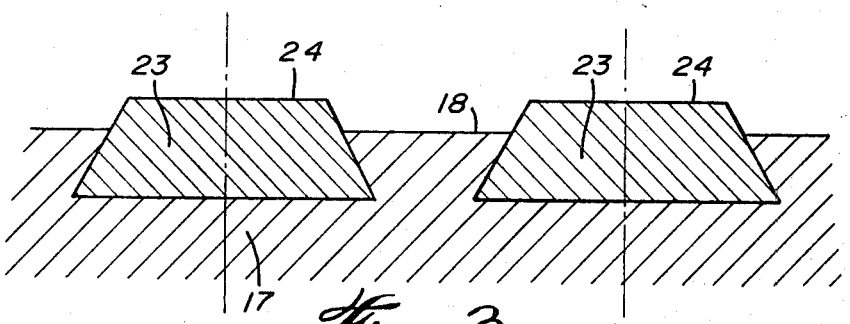
FIG. 3 shows an enlarged view of the example of FIG. 2 with preferred dimensions.

In FIG. 3 inserts 23 are shown with a flat upper surface 24 that protrude for example 0.055 inch above the upper surface of blade 18. In order to provide flexibility it is preferable to standardize the shape and size of the dovetailed grooves in the blade so that inserts having various protruding contours, as will be shown, but having standard dovetailed bases, are exchangeable. The pitch, or distance P, between centers of the inserts is for example 0.5 inch and the size of insert cross-section, which is trapezoidal in shape, is shown as 0.25 inch across the top, 0.375 inch across the bottom and 0.125 inch thick. The dovetailed groove in the blade will be cut to provide a snug sliding fit for the insert and have a depth of about 0.70 inch with sides sloping upward from the base at about a 63 degree angle.

Figure 4:
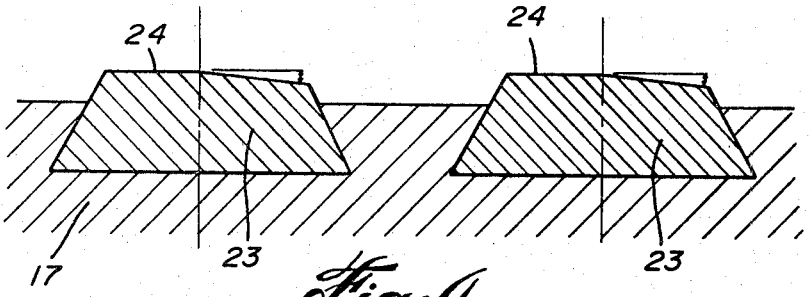
FIGS. 4, 5 and 6 show enlarged schematic cross-sectional views of several examples of the invention.

In the embodiment shown in FIG. 4 the downstream half of the top surface 24 of the inserts is cut to diverge downward at an angle $\gamma$ which may be from 0° to 10°.

Figure 5:
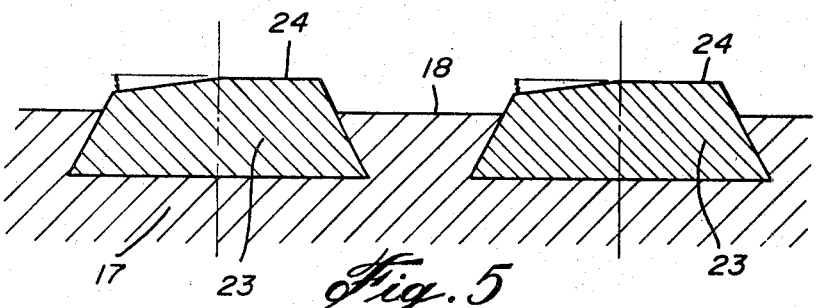

In the embodiment shown in FIG. 5 the upstream half of the top surface 24 of the insert is cut to diverge downward at an angle $\gamma 2$ which may be from 0° to 10°.

In FIG. 6 there is shown a method by which the pitch P may be doubled. As will be seen, this is accomplished by placing a filler insert 30 that is flush with the surface of the blade 18 between two protruding inserts.

Figure 7:
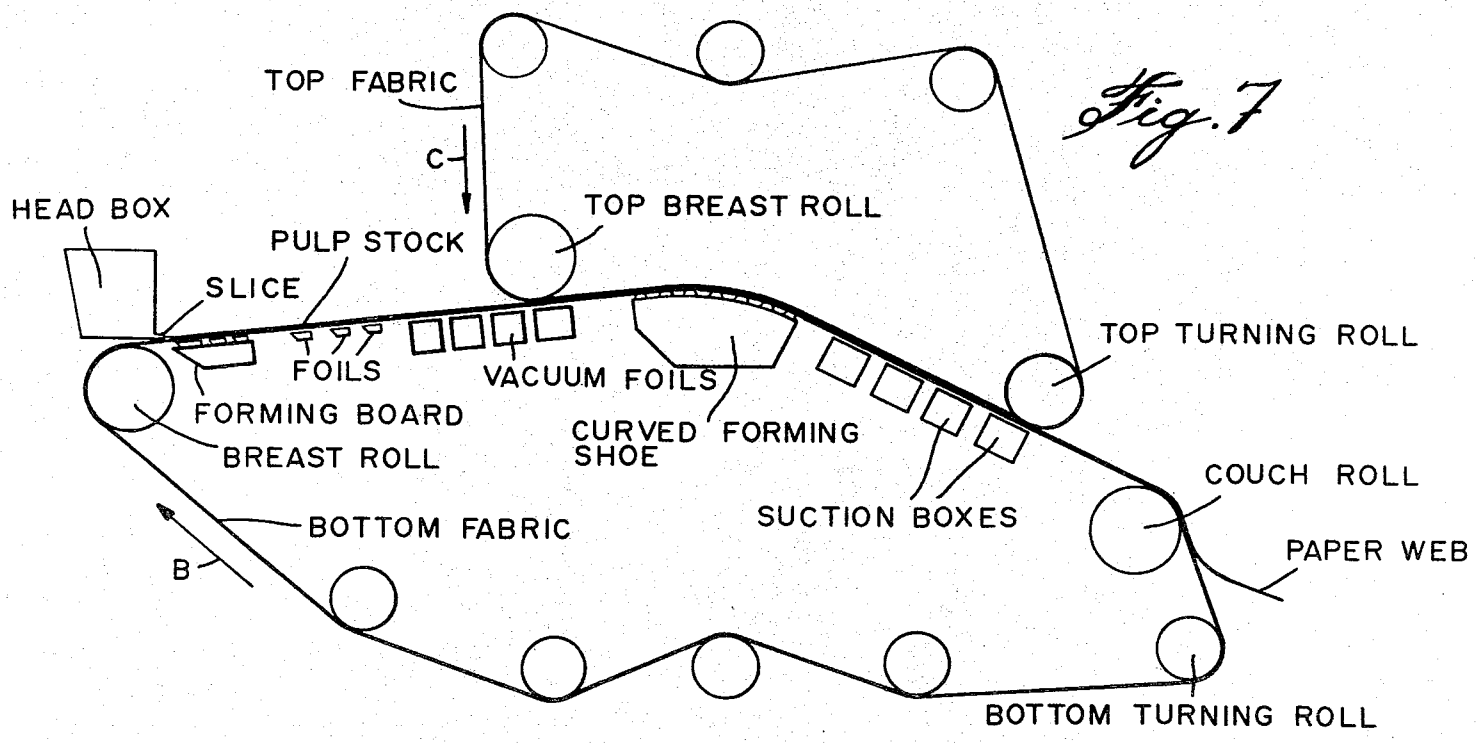
FIG. 7 is a simplified schematic side view of a hybrid type of twin wire paper former utilizing the present invention.

FIG. 7 is a schematic side view of a twin wire paper machine, made by Valmet Oy of Finland and known as a Symformer, in which the essential components are indicated. In this type of former, which is shown as an example, the bottom fabric runs in the direction shown by arrow B over the breast roll, under the slice and over and in contact with the forming board, foils, vacuum foils, curved forming shoe, suction boxes then around the couch roll, turning roll, various returning, guide and tensioning rolls and back to the breast roll. The top fabric runs in the direction shown by arrow C over the top breast roll and converges with the bottom fabric, in advance of the curved shoe, then follows the bottom fabric to the top turning roll from where it is returned over guide and tensioning rolls to the top breast roll. The pulp stock issuing from the slice is deposited on the bottom fabric just ahead of the forming board and is partially dewatered by the forming board, foils and vacuum foils before entering the nip between the converging fabric. As the fabrics are entrained, under some tension, around the curved surface of the form forming shoe, the outer (top) fabric is pressed towards the inner (bottom) fabric which bears against the shoe and more water is squeezed out of the pulp sandwiched between the fabrics thus forming the paper web. The paper web is removed from the bottom fabric after it passes over the couch roll.

In this type of machine the multiple protruding inserts may be placed in the forming board and foils and will also be placed in the surface of the curved forming shoe thereby inducing turbulence and mixing of the pulp stock between the two fabrics. An additional advantage of this embodiment is that it provides reduced contact area of the fabric on the shoe which reduces friction and hence power consumption.

The protruding inserts of the invention may be applied similarly to other hybrid and twin wire paper formers. For example, in the case of a roll former with Fourdrinier entrance such as the Duoformer F of J. M. Voith GmbH West Germany, the Dynaformer of Dominion Engineering Words, Canada and the Periformer H of Karistads Mekaniska Werkstad, Sweden, the multiple protruding inserts may be placed in the forming board and the foils. In the case of paper machines with a forming shoe with Fourdrinier entrance such as the Symformer (discussed earlier) and the Bel Bond of Beloit Corporation, U.S.A., the multiple protruding inserts may be placed in the forming board, the foils and the forming shoe. Also in the case of twin wire paper machines such as the Bel Baie of Beloit Corporation, the multiple protruding inserts may be placed in the forming shoe.

It is not intended to limit the invention to protruding inserts having a flat or partially divergent flat top surface as shown in the drawings. As conditions warrant, it may be advantageous to have a contoured shape at the protruding portion that may be crowned or curved in any way. It is thus intended to cover any obvious modifications falling within the scope of the broadest appended claims.

I claim:

1. A pulp agitating device comprising a support member having a single upper surface, a plurality of slots in said upper surface, each said slot having retention means for holding a respective one of a plurality of inserts in sliding engagement therein, said inserts being closely spaced and disposed in parallel relationship to one another and extending in a cross-machine direction and protruding above said upper surface to form cross-machine channels therebetween, said support member being supported in contact with a moving endless forming fabric of a paper-making machine to induce micro-pressure pulses to said moving forming fabric whereby fibers are agitated in pulp suspension on said fabric to obtain better distribution of said fibers.

2. A pulp agitating device as claimed in claim 1 wherein said inserts are removably secured in said upper surface.

3. A pulp agitating device as claimed in claim 2 wherein said retention means is constituted by a dovetailed slot having opposed side walls to receive an insert of dovetail cross-section.

4. A pulp agitating device as claimed in claim 2 wherein said inserts have a flat upper fabric support surface.

5. A pulp agitating device as claimed in claim 4 wherein said flat upper fabric support surface has a downstream portion diverging downwardly backwards at an angle of from 0° to 10° from said support surface.

6. A pulp agitating device as claimed in claim 4 wherein said flat upper fabric support surface has an upstream portion diverging downwardly frontwards at an angle of from 0° to 10° from said support surface.

7. A pulp agitating device as claimed in claim 2 wherein said inserts have an upper fabric support surface that has a contoured shape at the protruding portion that is curved in any way.

8. A pulp agitating device as claimed in claim 2 wherein said inserts are positioned in selected ones of said slots, there being provided filler inserts positioned in remaining ones of said slots, said filler inserts having a top surface in flush alignment with said upper surface of said support member.

9. A pulp agitating device as claimed in claim 1 wherein said inserts are made of wear-resistant material such as aluminum oxide, tungsten carbide, stainless steel coated with tungsten carbide.

10. A pulp agitating device as claimed in claim 9 wherein said plurality of inserts are spaced a distance that provides reduced contact area with the said moving endless forming fabric whereby to reduce friction therewith.

11. A pulp agitating device as claimed in claim 2 wherein said support member is a foil blade.

12. A pulp agitating device as claimed in claim 2 wherein said support member is a forming board blade.

13. A pulp agitating device as claimed in claim 2 wherein said support member is a curved forming shoe of a twin wire machine.

14. In combination with a forming section of a paper-making machine having a moving endless forming fabric on a surface of which is flowed a layer of pulp fibers in pulp suspension from a headbox slice, the improvement comprising a support member having a single upper surface located in contact with the other surface of said fabric, a plurality of slots in said upper surface, each said slot having retention means for holding a respective one of a plurality of inserts in sliding engagement therein, said inserts being closely spaced and disposed in parallel relationship to one another and extending in a cross-machine direction and protruding above said upper surface to form cross-machine channels therebetween to induce micro-pressure pulses to said moving forming fabric whereby fibers are agitated in said pulp suspension on said fabric to obtain better distribution of said fibers.

15. A method of agitating fibers in a pulp suspension in a moving endless forming fabric of a paper-making machine, said method comprising the steps of positioning a support element having a single upper surface having formed therein a plurality of slots provided with retention means for holding a respective one of a plurality of inserts in sliding engagement therein, positioning said inserts in said slots in closely spaced parallel relationship to one another and extending in a cross-machine direction and protruding above said upper surface to form cross-machine channels therebetween, displacing a surface of said forming fabric in contact with said inserts while supporting on an opposite surface said pulp suspension; inducing, by means of said channels, micro-pressure pulses to said moving forming fabric whereby fibers are agitated in said pulp suspension to obtain better distribution of said fibers.

* * * * *